US011535028B2

(12) United States Patent
De Rauw et al.

(10) Patent No.: US 11,535,028 B2
(45) Date of Patent: Dec. 27, 2022

(54) METHOD FOR FIXING AND TREATING A FLEXIBLE PLATE ON A DRUM AND FLEXIBLE PLATE

(71) Applicant: XEIKON PREPRESS N.V., Ypres (BE)

(72) Inventors: Dirk Ludo Julien De Rauw, Ninove (BE); Marnix Gabriel Feys, Dottignies (BE)

(73) Assignee: XEIKON PREPRESS N.V., Leper (BE)

( * ) Notice: Subject to any disclaimer, the term of this patent is extended or adjusted under 35 U.S.C. 154(b) by 278 days.

(21) Appl. No.: 16/771,317

(22) PCT Filed: Dec. 18, 2018

(86) PCT No.: PCT/EP2018/085378
§ 371 (c)(1),
(2) Date: Jun. 10, 2020

(87) PCT Pub. No.: WO2019/121605
PCT Pub. Date: Jun. 27, 2019

(65) Prior Publication Data

US 2020/0338880 A1 Oct. 29, 2020

(30) Foreign Application Priority Data

Dec. 18, 2017 (NL) ..... 2020109

(51) Int. Cl.
*B41F 27/00* (2006.01)
*B41F 27/12* (2006.01)

(52) U.S. Cl.
CPC ..... *B41F 27/005* (2013.01); *B41F 27/1212* (2013.01)

(58) Field of Classification Search
CPC ..... B41F 27/005; B41F 27/1212
See application file for complete search history.

(56) References Cited

U.S. PATENT DOCUMENTS 3,110,107 A 11/1963 Wilhelm
9,238,359 B2 * 1/2016 Koberg ..... B41F 27/02
2010/0242760 A1 9/2010 Otsuka et al.

FOREIGN PATENT DOCUMENTS

CN 1210483 A 3/1999
CN 1495018 A 5/2004
(Continued)

OTHER PUBLICATIONS

International Search Report and Written Opinion for the International Patent Application No. PCT/EP2018/085378, dated Mar. 13, 2019, 17 pages.

*Primary Examiner* — Matthew G Marini
*Assistant Examiner* — Marissa Ferguson-Samreth
(74) *Attorney, Agent, or Firm* — KDB Firm PLLC

(57) ABSTRACT

A method for fixing and treating a flexible plate on a drum includes: providing a flexible plate comprising a support layer made of a first material and at least one additional layer made of a second material which is different from the first material, wherein one or more thin film side wings are connected to one or more sides of the flexible plate. The one or more thin film side wings have a thickness which is at least 5 times smaller than the thickness of the flexible plate. The method further includes positioning the flexible plate on the drum such that the lower face of each thin film side wing of the flexible plate covers at least one vacuum suction opening, and performing a treatment on at least one layer of the flexible plate while rotating the drum.

24 Claims, 5 Drawing Sheets

(56) References Cited

FOREIGN PATENT DOCUMENTS

| | | | | | |
|---|---|---|---|---|---|
| CN | 1846999 | A | | 10/2006 | |
| CN | 1994737 | A | | 7/2007 | |
| CN | 101352957 | A | | 1/2009 | |
| CN | 103153622 | A | * | 6/2013 | ..... B41F 27/06 |
| CN | 103153622 | A | | 6/2013 | |
| CN | 105722774 | A | | 6/2016 | |
| CN | 106903973 | A | * | 6/2017 | ..... B41C 1/00 |
| CN | 106903973 | A | | 6/2017 | |
| EP | 0246012 | A2 | | 11/1987 | |
| EP | 1470915 | A1 | | 10/2004 | |
| EP | 2253471 | A1 | | 11/2010 | |
| EP | 2778785 | A2 | | 9/2014 | |
| JP | 2004322388 | A | | 11/2004 | |
| JP | 2010234635 | A | | 10/2010 | |
| WO | 8806522 | A1 | | 9/1988 | |
| WO | WO-2010001667 | A1 | * | 1/2010 | ..... B41F 27/02 |

* cited by examiner

METHOD FOR FIXING AND TREATING A FLEXIBLE PLATE ON A DRUM AND FLEXIBLE PLATE

This is a national stage application filed under 35 U.S.C. § 371 of pending international application PCT/EP2018/085378, filed Dec. 18, 2018, which claims priority to Netherlands Patent Application No. NL 2020109, filed Dec. 18, 2017, the entirety of which applications are hereby incorporated by reference herein.

FIELD OF INVENTION

The field of the invention relates to methods for fixing and treating a flexible plate on a rotatable drum, to a flexible plate for use in such methods, and to a treated flexible plate obtained by such methods.

BACKGROUND

It is known to fix a flexible plate, e.g. a printing plate or a relief precursor plate, on a drum for further treatment, e.g. an imaging treatment. To that end the drain is provided with a plurality of vacuum suction openings. The flexible plate comprises a support layer made of a first material and at least one additional layer made of a second material. The known method comprises: positioning the flexible plate on the drum, and fixing the flexible plate against the drum by applying a vacuum through the plurality of vacuum suction openings, wherein optionally a tape may be used to enhance the fixing of the flexible plate; rotating the drum whilst applying vacuum through the plurality of vacuum suction openings, and performing a treatment on at least one layer of said at least one additional layer of the flexible plate whilst rotating the drum.

Especially when the flexible plate is relatively thick and/or when the rotational speed of the drum is relatively high, existing methods require the use of tape in order to avoid that opposite sides of the flexible plate extending in a circumferential direction of the drum detach during rotation. Further, when the flexible plate has a limited length which is shorter than the circumference of the drum, it is typically required to add separate sheets to close vacuum suction openings

SUMMARY

The object of embodiments of the invention is to provide an improved method for fixing and treating a flexible plate on a rotatable drum, and more in particular a method which avoids the use of tape for fixing the flexible plate on the drum, whilst allowing higher rotational speeds of the drum compared to prior art methods where no tape is used.

According to a first aspect of the invention there is provided a method for fixing and treating flexible plate on a drum a plurality of vacuum suction openings. The method comprises providing a flexible plate with a support layer made of a first material and at least one additional layer made of a second material which is different from said first material, wherein one or more thin film side wings are connected to one or more sides of the flexible plate, said one or more thin film side wings having a thickness which is at least 5 times, more preferably at least 10 times, even more preferably at least 50 times smaller than the thickness of the flexible plate. The one or more thin film side wings have a lower face which is substantially free from adhesive. The method further comprises: positioning the flexible plate on the drum such that the lower face of each thin film side wing of the flexible plate covers at least one vacuum suction opening of the plurality of vacuum suction openings (whilst not sticking to the drum); rotating the drum whilst applying vacuum through plurality of vacuum suction openings, and performing a treatment on at least one layer of said at least one additional layer of the flexible plate whilst rotating the drum.

By providing a flexible plate with one or more thin film side wings on one or more sides, the flexible plate can be fixed in an improved manner on the drum using vacuum, without sticking the flexible plate on the drum. Indeed, the one or more thin film side wings extend over at least one vacuum suction opening so that the one or more sides of the flexible plate can be maintained fixed against the drum, also when the drum rotates at a high speeds. By adding one or more side wings whose thickness is at least 5 times, more preferably at least 10 times, even more preferably at least 50 times smaller than the thickness of the flexible plate, the risk that the one or more sides are detached is significantly reduced. Compared to prior art methods, the embodiments of the method of the invention will allow to operate the drum at higher rotational speeds without the need for taping the flexible plate to the drum and/or without the need for adding additional separate sheets to close vacuum suction openings between a leading and a trailing edge of the flexible plate. This results in a faster process which avoids a taping step and/or a step of adding additional separate sheets. Further, since no taping step is needed, the method may be more easily automated by implementing e.g. an automated loading of the flexible plate on the drum.

According to a preferred embodiment, the one or more thin film side wings comprise two longitudinal thin film side wings at opposite longitudinal sides of the flexible plate, and the flexible plate is positioned on the drum with the two longitudinal thin film side wings oriented in a circumferential direction of the drum. Without the thin film side wings, there is a risk that the opposite sides of the flexible plate become detached from the drum, especially when the flexible plates are relatively thick and/or when the rotational speed of the drum is high. This is avoided when two longitudinal thin film side wings are used which are oriented in a circumferential direction of the drum, as they will help in maintaining the longitudinal sides of the flexible pushed against the drum.

According to an exemplary embodiment, the one or more thin film side wings comprise a leading and/or trailing thin film side wing attached to a leading and/or trailing edge of the flexible plate; and the flexible plate is positioned on the drum with the leading and/or trailing thin film side wing oriented parallel to an axial direction of the drum such that, when positioned on the drum, the leading and/or trailing thin film side wing cover a portion between a leading edge and a trailing edge of the flexible plate. Such an embodiment will be useful when the length of the plate measured between the leading and the trailing edge is smaller than the circumference of the drum, as it can be avoided that additional separate sheets are needed to close vacuum suction openings between the leading and the trailing edge of the flexible plate, it is noted that the provision of a leading and/or trailing thin film side wing may be combined with the provision of two longitudinal thin film side wings. However, it is also possible to provide: only a leading and/or trailing thin film side wing, e.g. when the rotational speed is relatively low.

According to a preferred embodiment, the performing of a treatment comprises removing material from at least one layer of the at least one additional layer. For example, material of at least one layer may be removed in accordance with image data, More in particular, the performing of a treatment may comprise any one of the following: exposure to electromagnetic waves; engraving, e.g. mechanical engraving; exposure to material jets, such as particle jets, fluid jets, gas jets; exposure to a plasma; exposure to a continuous web such as for thermal development; or combinations thereof. The electromagnetic waves may be e.g. any one of the following: broadband electromagnetic waves, narrow band electromagnetic waves, monochromatic electromagnetic waves, large area electromagnetic waves e.g. with a lamp, selective electromagnetic waves, e.g. emitted by a laser, waves emitted along the full axial length of the drum or along a portion of the axial length of the drum, continuous or pulsed electromagnetic waves, high or low energy electromagnetic waves, ablation or initiation electromagnetic waves, UV to IR electromagnetic waves. The wavelength of the electromagnetic waves may be in the range from 200 to 20000 nm, preferably in the range of 250 to 15000 nm, more preferably in the range of 300 to 11000 nm, most preferably in the range of 350 to 11000 nm. The total power of the electromagnetic radiation may range from low values which are enough to trigger a chemical reaction to high values causing fast healing and evaporation or ablation of material, e.g. in the range form 0.1 mW to 2000 W, preferably from 1 mW to 1000 W, more preferably from 5 mW to 7500 W, most preferably from 1 W to 200 W.

For thermal development, a thermal development unit with a drum with vacuum suction capabilities may be used, wherein the flexible plate is fixed on the rotating drum. The thermal developing unit further comprises assemblies for heating the at least one additional layer and also assemblies for contacting an outer surface of the heated, at least one additional layer with an absorbent material for absorbing material in a molten state. The assemblies for heating may comprise a heatable underlay for the flexible plate and/or IR lamps disposed above the at least one additional layer. The absorbent material may be pressed against the surface of the at least one additional layer by means, for example, of an optionally heatable roll. The absorbent material may be continuously moved over the surface of the flexible plate while the drum is rotating with repeatedly removal of material of the at least one additional layer. In this way molten material is removed whereas non-molten areas remain and form a relief.

According to a preferred embodiment, the performing of a treatment comprises exposure to at least one laser beam, preferably in accordance with image data.

According to a preferred embodiment, the one or more thin film side wings are fixed to the support layer. In that manner the one or more thin film side wings are fixed close to a bottom side of the flexible plate, which is intended to be fixed against the drum, resulting in a good tightness when fixed on the drum. More preferably, the one or more thin film side wings and the support layer are formed as one integral film layer. In that manner the support layer and one or more thin film side wings can be made of a single film resulting in an easy fabrication of the flexible plate.

According to a preferred embodiment, the plurality of vacuum suction openings form a pattern extending in a circumferential direction and in an axial direction of the drum, wherein, seen in the axial direction the vacuum suction openings are arranged at a predetermined maximum distance of each other, and wherein a width (w) of each longitudinal thin film side wing of the flexible plate is larger than said predetermined maximum distance, such that at least one vacuum suction opening is covered by each longitudinal thin film side wing.

Preferably, the width of the longitudinal thin film side wings, seen in a direction perpendicular on the opposite longitudinal sides of the flexible plate, is larger than 0.5 mm, more preferably larger than 10 mm. For typical drums used in flexography the predetermined maximum distance between the vacuum suction openings, e.g. shaped as slots extending in a circumferential direction, may be about 10 mm, and for such embodiments a width of the longitudinal thin film side wings larger than 10 mm, e.g. between 15 and 50 mm is preferred.

Preferably, the width of the longitudinal thin film side wings, seen in a direction perpendicular on the opposite longitudinal sides, is smaller than 100 mm. More in particular the longitudinal thin film side wings do not have to be unnecessarily wide.

According to a preferred embodiment, the plate is substantially rectangular. Preferably the one or more thin film side wings each extend over at least 50% of the length of the respective side, preferably over at least 75%, more preferably over at least 85%, even more preferably over substantially the entire length of the respective side. In other cases, for example where the length of the one or more thin film side wings is not crucial they may extend over more than the entire length of the respective sides. This may also be advantageous to seal further vacuum suction openings, when the length of the flexible plate is less than the circumference. In that manner, when the one or more side wings comprise two longitudinal side wings, one long vacuum suction opening extending in the circumferential direction of the drum, or a plurality of vacuum suction openings extending in the circumferential direction, may be covered easily by the thin film side wings. Also, when the one or more side wings comprise a leading and/or trailing side wing, such side wing can cover the entire area between the leading and trailing edge of the flexible plate when mounted on the drum.

According to a preferred embodiment, the at least one additional layer comprises a photosensitive layer. The performing of a treatment on at least one layer may then comprise exposing areas of said photosensitive layer e.g. using a laser to expose the photosensitive layer directly while the flexible plate is rotated with the drum.

So called digital relief plates comprise an additional mask layer which is removed by laser ablation and forms a mask comprising the image information. In a preferred embodiment the partial ablation of the mask layer corresponds with the step of performing a treatment on at least one layer of said at least one additional layer of the flexible plate whilst rotating the drum. In the most preferred embodiment, the at least one additional layer comprises a photosensitive layer and a mask layer on said photosensitive layer, and the performing of a treatment on at least one layer may then comprise exposing areas of the photosensitive layer through the mask layer.

According to a preferred embodiment, the radius of the drum is larger than 10 cm, e.g. between 15 cm and 100 cm.

According to a preferred embodiment, the drum is rotated with a speed which is between 10 and 5000 rpm, more preferable between 250 rpm and 1000 rpm, e.g. between 300 rpm and 400 rpm.

According to a preferred embodiment, the flexible plate is a relief precursor. This may be a relief precursor for a printing plate or for any other plate requiring a relief pattern. The relief precursor may be any one of the following: a direct engravable plate, i.e. a plate in which a pattern, e.g. an image pattern, can be directly engraved e.g. by a laser; a solvent or water developable relief precursor, i.e. a flexible plate having an additional layer that can be dissolved by a solvent or by water in order to obtain a relief plate; a thermally developable relief precursor, i.e. a plate having a meltable additional layer in which a relief may be applied e.g. by removal of molten material; a flexible plate with a photosensitive layer as described above. The flexible plate may also be a relief precursor intended to obtain a plate with a relief structure which is not a printing plate, e.g. the flexible plate may be a relief precursor for a microreactor or a Fresnel lens.

According to a preferred embodiment, the one or more thin film side wings are provided as any one of the following: natural or artificial polymer films, coated paper, a combination thereof.

According to a preferred embodiment, the one or more thin film side wings have a thickness which is smaller than 750 micron, more preferably smaller than 500 micron, e.g. between 150 and 500 micron. Preferably, the flexible plate has a thickness between 1 mm and 10 mm, more preferably, between 2 mm and 8 mm, e.g. between 3 and 7 mm.

According to a preferred embodiment, the ratio of the thickness of the at least one additional layer and the support layer is in the range from 5:1 to 100:1.

According to a preferred embodiment, the ratio of the width (w) of the thin film side wings to the thickness (t) of the flexible plate is in the range of 5:1 to 500:1.

To provide the thin film side wings various methods may be considered, such as for example:

- adhering a support and side wing layer to at least one additional layer to form a flexible plate, wherein the width of the support and side wing layer is larger than the width of the at least one additional layer, such that one or more thin film side wings of the support and side wing layer are not covered by the at least one additional layer in order to form the one or more thin film side wings at opposite side of the flexible plate;
- forming of at least one additional layer on a support layer and removing one or more side portions of the at least one additional layer such that the one or more thin film side wings are created at one or more sides of the support layer. The removal of the side portions of the at least one additional layer may be performed by abrasion, sanding, burring, drilling, milling, rotary cutting, ablating, or combinations thereof;
- adhering a support layer to at least one additional layer to form a flexible plate, wherein width of the support layer is the same as or similar to the width of the at least one additional layer; and wherein one or more thin film side wings are fixed to the support layer at one or more sides of the flexible plate, e.g. by gluing or by tape.

According to another aspect there is provided a treated flexible plate obtained according to the method of any one of the previous embodiments.

According to yet another aspect there is provided a flexible plate suitable to be fixed on a drum, said flexible plate comprising a support layer made of a first material and at least one additional layer made of a second material which is different from said first material. The at least one additional layer is intended for being modified whilst fixed on the drum. The flexible plate is provided with one or more thin film side wings on one or more sides of the flexible plate, said one or more thin film side wings having a thickness which is at least 5 times, more preferably at least 10 times, even more preferably at least 50 times smaller than the thickness of the flexible plate.

The flexible plate has a leading edge and a trailing edge and two opposite longitudinal sides extending between the leading and the trailing edge. Preferably, the one or more thin film side wings comprise:

- two longitudinal thin film side wings connected to the opposite longitudinal sides of the flexible plate; and/or
- a leading and/or trailing thin film side wing connected to the leading and/or trailing edge of the flexible plate.

Preferably, the one or more thin film side wings are fixed to the support layer, and more preferably the one or more thin film side wings and the support layer are formed as one integral film layer.

According to a possible embodiment, the flexible plate is substantially rectangular and the one or more thin film side wings each extend over at least 50% of the length of the respective side, preferably over at least 75%, more preferably over at least 80%, and most preferably substantially the entire length of the respective side. A thin film side wing may also extend over more than the entire length of the respective side, especially when the sides adjoining the respective side are also provided with a side wing. For example, the thin film side wings may form a frame around the support layer.

According to another possible embodiment, the one or more sides of the flexible plate are each provided with a plurality of thin film side wings, wherein said plurality of thin film side wings extend over at least 50% of the length of the respective side, preferably over at least 75%, more preferably over at least 80%, and most preferably over substantially the entire length of the respective side. In other words, instead of providing one long thin film side wing on a side of the flexible plate, it is also possible to provide a plurality of short thin film side wings on a side of the flexible plate.

According to a preferred embodiment the one or more thin film side wings are provided as any one of the following: natural or artificial polymer films, coated paper, a combination thereof. Preferably, the one or more thin film side wings comprise any one of the following materials: flexible metal films, polymer or polymer derivatives, such as polyalkenes (polyethylene, polyisoprene, polybutadiene), polyamines, polyethers, polyols, polyesters (PET), polyamides, polyimides, polysaccharides; starch; cellulose.

According to a preferred embodiment the thin film side wings are substantially parallel. Substantially parallel means that the angle between the two sides is less than 10°.

Further preferred embodiments of the flexible plate are disclosed in the claims and/or in connection with embodiments of the method.

The advantages and features disclosed above for the method apply mutatis mutandis for the flexible plate.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1A:
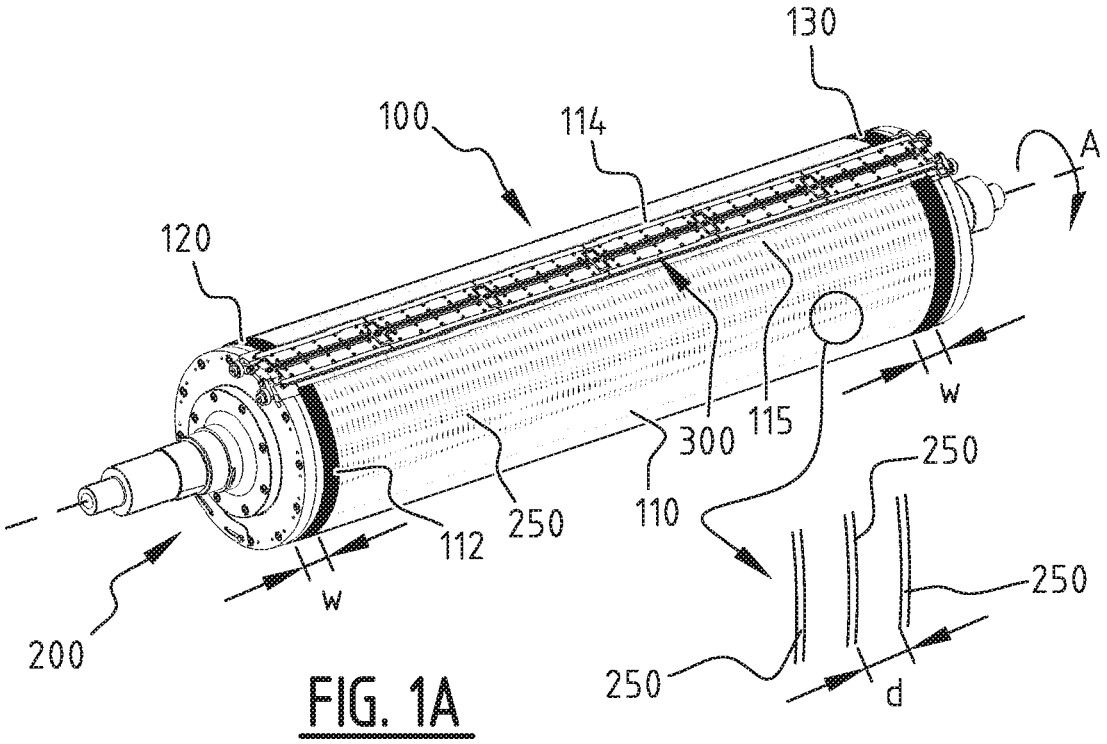
FIGS. 1A and 1B are schematic views of a flexible plate fitted on a drum in accordance with exemplary embodiments of the method of the invention.
Figure 1B:
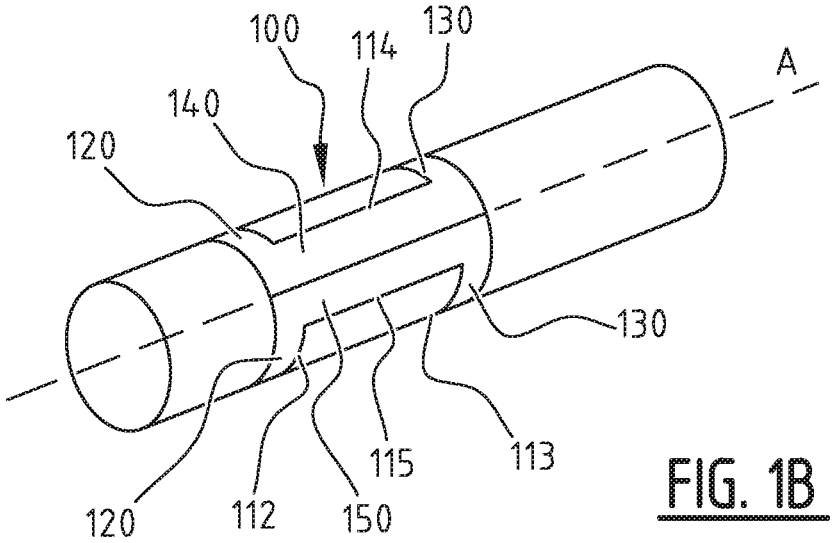

FIG. 1A illustrates an exemplary embodiment of a method for fixing and treating a flexible plate 100 on a drum 200 with a plurality of vacuum suction openings 250. In FIG. 1 the flexible plate 100 is shown in a position where it is positioned on the drum 200.

Figure 2A:
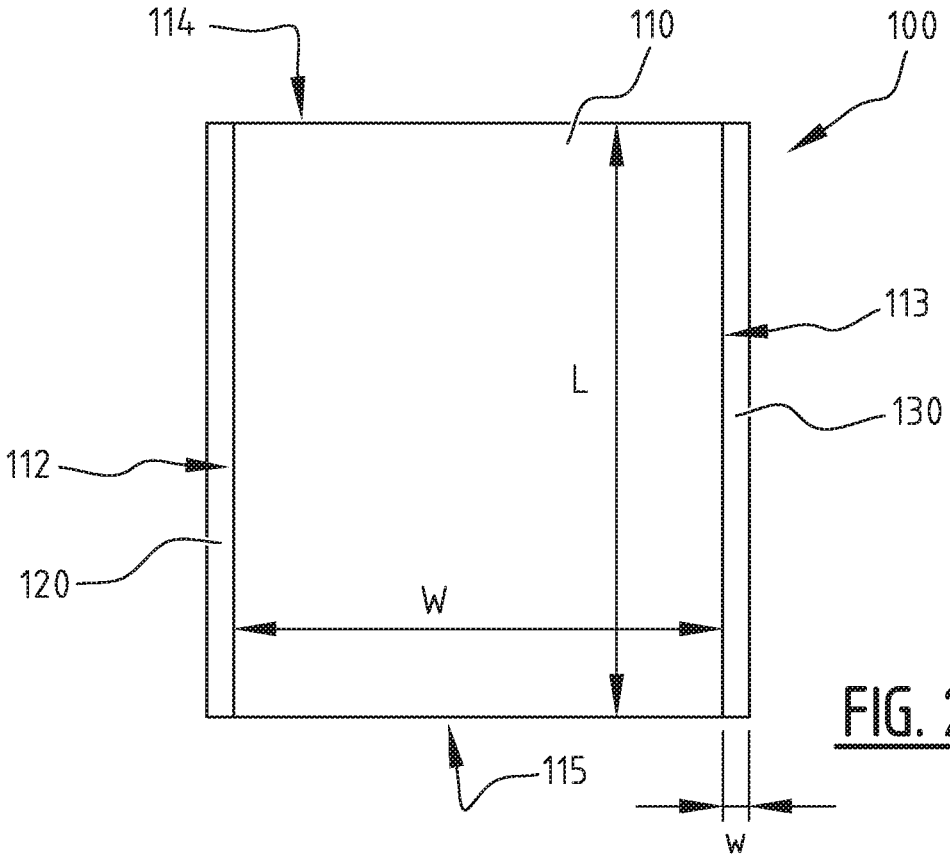
FIGS. 2A and 2B are a schematic top view and a partial perspective view of an exemplary embodiment of a flexible plate, respectively.
Figure 2B:
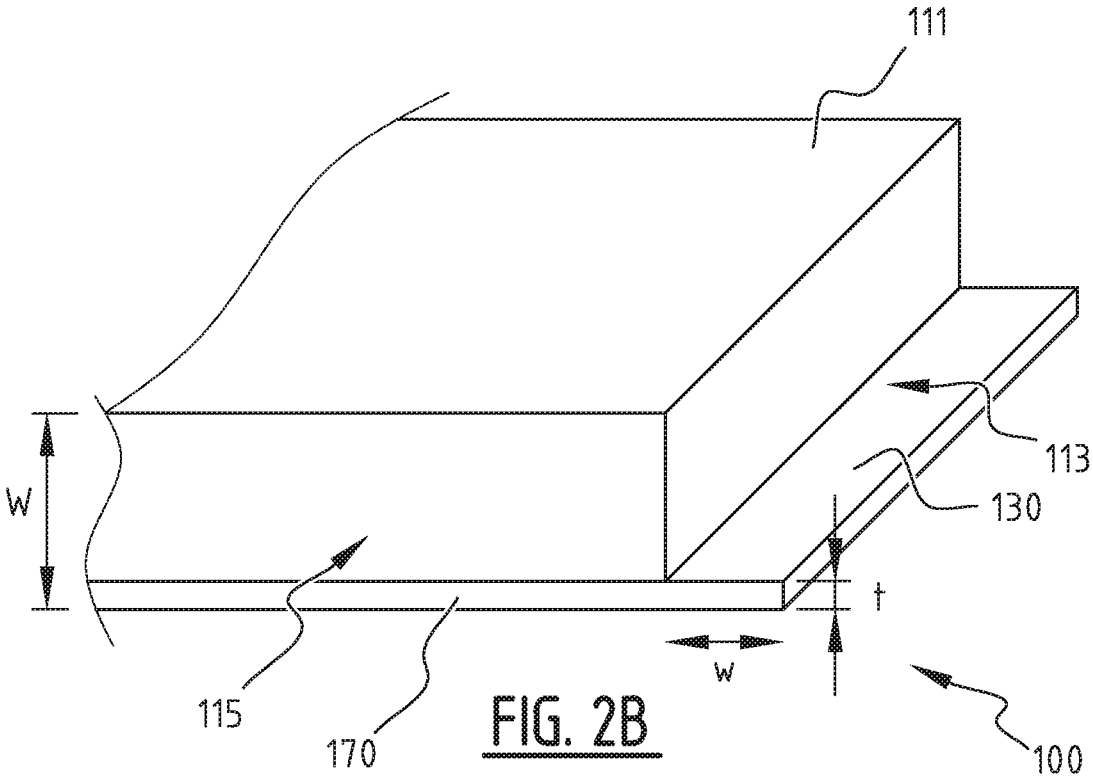

The flexible plate 100 of FIG. 1A is shown in detail in FIGS. 2A and 2B separate from the drum 200. The flexible plate 100 comprises a support layer 170 made of a first material and an additional layer made 110 of a second material which is different from said first material. The support layer 170 may be a flexible metal, a natural or artificial polymer, paper or combinations thereof. Preferably the support layer 170 is a flexible metal or polymer film or sheet. In case of a flexible metal, the support layer could comprise a thin film, a sieve like structure, a mesh like structure, a woven or non-woven structure or a combination thereof. Steel, copper, nickel or aluminium sheets are preferred and may be about 50 to 1000 μm thick. In case of a polymer film, the film is dimensionally stable but bendable and may be made for example from polyalkylenes, polyesters, polyethylene terephthalate, polybutylene terephthalate, polyamides and polycarbonates, polymers reinforced with woven, nonwoven or layered fibres (e.g. glass fibres, Carbon fibres, polymer fibres) or combinations thereof. Preferably polyethylene and polyester foils are used and their thickness may be in the range of about 100 to 300 μm, preferably in the range of 100 to 200 μm.

Figure 3:
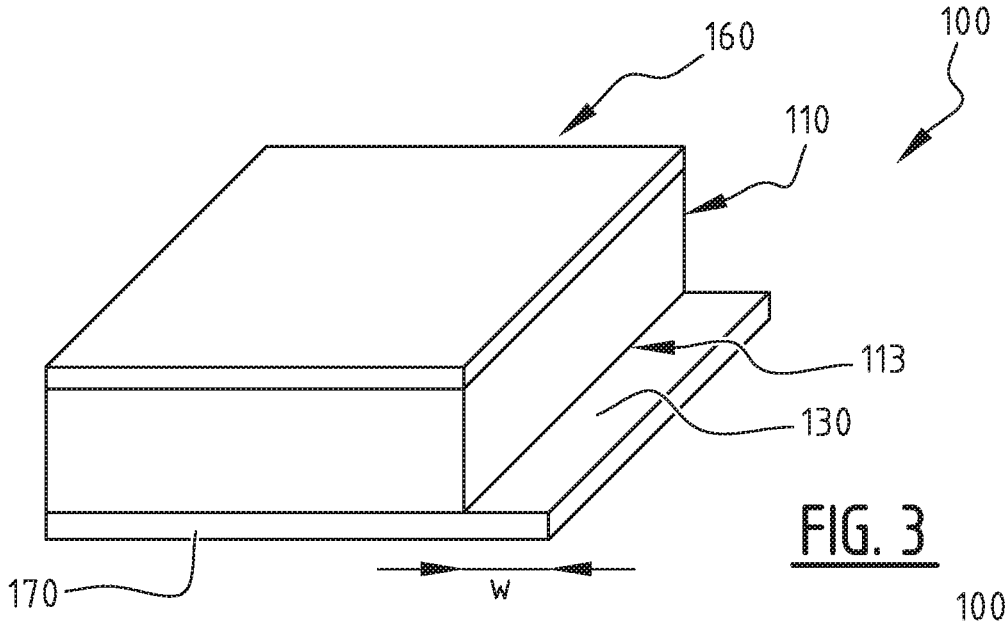
FIGS. 3, 4 and 5 are schematic partial perspective views of other exemplary embodiments of a flexible plate illustrating different ways of adding the thin film side wings to the flexible plate.

The flexible plate 100 is preferably a relief precursor with an additional layer 110 intended to contain a relief structure after treatment on the drum 200. For example, the additional layer 110 may be any one of the following: a direct engravable layer (e.g. by laser), a solvent or water developable layer, a thermally developable layer, a photosensitive layer, a combination of a photosensitive layer and a mask layer. Optionally there may be provided one or more further additional layers 160 on top of additional layer 110, see FIG. 3. Such one or more further additional layers may comprise a cover layer at the top of all other layers which is removed before the imagable layer is imaged. The one or more additional layers may comprise a relief layer, and an anti-halation layer between the support layer and the relief layer or at a side of the support layer which is opposite of the relief layer. The one or more additional layers may comprise a relief layer, an imagable layer, and one or more barrier layers between the relief layer and the imagable layer which prevent diffusion of oxygen. Between the different layers described above one or more adhesion layers may be located which ensure proper adhesion of the different layers.

In a preferred embodiment the flexible plate 100 is a relief printing plate precursor, preferably with a support layer 170 made of a polyester of polymer material, and with an additional layer 110 made of a directly engravable material such as a resin material. The optional layer 160 may then be a laser ablative layer. In an exemplary embodiment the printing precursor may contain at least a dimensionally stable support layer 170, a relief layer 110 and an imagable mask layer 160.

Optionally, further layers may be present. There may be a cover layer at the top of all other layers which is removed before the imagable mask layer 160 is imaged. There may be an anti-halation layer between the support layer 170 and the relief layer 110 or it may be located at the side of the support layer 170 which is opposite of the relief layer 110. There may be one or more barrier layers between the relief layer 110 and the imagable mask layer 160 which prevent diffusion of oxygen. Between the different layers described above one or more adhesion layers may be located which ensure proper adhesion of the different layers. One or more layers may be removable by treatment with a liquid. The liquids used may be the same or different for different layers. Preferably the liquids used are different.

In a preferred embodiment the flexible plate is a relief precursor with a photosensitive layer and a mask layer. The mask layer may be ablated or changed in transparency during the treatment and forms a mask with transparent and non-transparent areas. Underneath of transparent areas of the mask the photosensitive layer undergoes a change in solubility and/or fluidity upon irradiation. The change is used to generate the relief by removing parts of the photosensitive layer in one or more subsequent steps. The change in solubility and/or fluidity may be achieved by photo-induced polymerization and/or crosslinking, rendering the irradiated areas less soluble and less meltable. In other cases the electromagnetic radiation may cause breaking of bonds or cleavage of protective groups rendering the irradiated areas more soluble and/or meltable. Preferably a process using photo-induced crosslinking and/or polymerization is used.

In an embodiment the flexible plate comprises a photosensitive layer comprising at least a photo-initiator or a photo-initiator system, a binder and a reactive compound or monomer. A photo-initiator is a compound which upon irradiation with electromagnetic radiation may form a reactive species which can start a polymerization reaction, a crosslinking reaction, a chain or bond scission reaction which leads to a change of the solubility and/or meltability of the composition. Photo-initiators are known which cleave and generate radicals, acids or bases. Such initiators are known to the person skilled in the art and described e.g. in: Bruce M. Monroe et al., Chemical Review, 93, 435 (1993), R. S. Davidson, Journal of Photochemistry and Biology A: Chemistry, 73, 81 (1993), J. P. Faussier, Photoinitiated Polymerization Theory and Applications: Rapra Review. Vol. 9, Report, RapraTechnology (1998), M. Tsunooka et al., 25 Prog. Polym. Sci., 21, 1 (1996), F. D. Saeva, Topics in Current Chemistry, 1 56, 59 (1990), G. G. Maslak, Topics in Current Chemistry, 168, 1 (1993), H. B. Shuster et al., JAGS, 112, 6329 (1990) and I. D. F. Eaton et al., JAGS, 102, 3298 (1980), P. Fouassier and J. F. Rabek, Radiation Curing in Polymer Science and Technology, pages 77 to 117 (1993) or K. K. Dietliker, Photoinitiators for free Radical and Cationic Polymerisation, Chemistry & Technology of UV & EB Formulation for Coatings, Inks and Paints, Volume, 3, Sita Technology LID, London 1991; or R. S. Davidson, Exploring the Science, technology and Applications of U.V. and E.B. Curing, Sita Technology LTD, London 1999. Further initiators are described in JP45-37377, JP44-86516, U.S. Pat. Nos. 3,567,453, 4,343,891, EP109772, EP109773, JP63138345, JP63142345, JP63142346, JP63143537, JP4642363, JP59152396, JP611151197, JP6341484, JP2249 and JP24705, JP626223, JP6314340, JP1559174831, JP1304453 and JP1152109.

Binders are linear, branched or dendritic polymers which may be homopolymers or copolymers. Copolymers can be random, alternating or block copolymers. As binder, those polymers which are either soluble, dispersible or emulsifiable in either aqueous solutions, organic solvents or combinations of both are used. Suitable polymeric binders are those conventionally used for the production of letterpress printing plates, such as completely or partially hydrolyzed polyvinyl esters, for example partially hydrolyzed polyvinyl acetates, polyvinyl alcohol derivatives, e. g. partially hydrolyzed vinyl acetate/alkylene oxide graft copolymers, or polyvinyl alcohols subsequently acrylated by a polymer-analogous reaction, as described, for example, in EP-A-0079514, EP-A-0224164 or EP-A-0059988, and mixtures thereof. Also suitable as polymeric binders are polyurethanes or polyamides which are soluble in water or water/alcohol mixtures, as described, for example, in EP-A-00856472 or DE-A-1522444. For flexographic printing precursors elastomeric binders are used. The thermoplastic-elastomeric block copolymers comprise at least one block which consists essentially of alkenylaromatics, and at least one block which consists essentially of 1,3-dienes. The alkenylaromatics may be, for example, styrene, α-methylstyrene, or vinyltoluene. Styrene is preferable. The 1,3-diener are preferably butadiene and/or isoprene. These block copolymers may be linear, branched, or radial block copolymers. Generally speaking, they are triblock copolymers of the A-B-A type, but they may also be diblock polymers of the A-B type, or may be polymers having a plurality of alternating elastomeric and thermoplastic blocks. A-B-A-B-A, for example. Mixtures of two or more different block copolymers may also be used. Commercial triblock copolymers frequently include certain fractions of diblock copolymers. The diene units may be 1,2- or 1,4-linked. Also possible for use, furthermore, are thermoplastic elastomeric block copolymers with styrene and blocks and a random styrene-butadiene middle block. Use may also be made, of course, of mixtures of two or more thermoplastic-elastomeric binders, provided that the properties of the relief-forming layer are not negatively impacted as a result. As well as the stated thermoplastic-elastomeric block copolymers, the photopolymerizable layer may also comprise further elastomeric binders other than the block copolymers. With additional binders of this kind, also called secondary binders, the properties of the photopolymerizable layer can be modified. Examples of a secondary binder are vinyltoluene-a-methylstyrene copolymers. These polymer hinders account for in general from 20 to 98%, preferably from 50 to 90% by weight of the total amount of the layer.

Reactive compounds or monomers which are suitable for the preparation of the mixtures are those which are polymerizable and are compatible with the binders. Useful monomers of this type generally have a boiling point above 100° C. They usually have a molecular weight of less than 3000, preferably less than 2000. The ethylenically unsaturated monomers used ought to be compatible with the hinders, and they have at least one polymerizable, ethylenically unsaturated group. As monomers it is possible in particular to use esters or amides of acrylic acid or methacrylic acid with mono- or polyfunctional alcohols, amines, aminoalcohols or hydroxyethers and hydroxyesters, esters of fumaric acid or maleic, acid, and allyl compounds. Esters of acrylic acid or methacrylic acid are preferred. Preference is given to 1,4-butanediol diacrylate, 1,6-hexanediol diacrylate, 1,6-hexanediol dimethacrylate, 1,9-nonanediol diacrylate, or trimethylolpropane tri(meth)acrylate. Mixtures of different monomers can of course be used. The total amount of all the monomers used in the relief-forming layer together is generally 1 to 20 wt %, preferably 5 to 20 wt %, based in each case on the sum of all the constituents of the relief-forming layer. The amount of monomers having two ethylenically unsaturated groups is preferably 5 to 20 wt %, based on the sum of all constituents of the relief-forming layer, more preferably 8 to 18 wt %.

The photosensitive layer may comprise further components. The further components are selected from the group consisting of a further polymer, a filler, a plasticizer, an anti-blocking agent, a monomer, an additive (e.g. a stabilizer, a dye), a stabilizer, a crosslinker, a binder, a colour forming compound, a dye, a pigment, an antioxidant and combinations thereof.

In a further embodiment the flexible plate comprises a photosensitive layer as described above and a mask layer, the mask layer comprising at least a compound capable of absorbing electromagnetic radiation and a component capable of being removed by ablation (also known as digital plate precursor). Preferably the mask layer is an integral layer of the relief precursor and is in direct contact with the photosensitive layer or with a functional layer disposed between photosensitive layer and mask layer. This functional layer is preferably a barrier layer and blocks oxygen. The mask layer may be imagable by ablation and removable by solvents or by thermal development. The mask layer is heated and removed by irradiation with high energy electromagnetic radiation, whereby an image-wise structured mask is formed, which is used to transfer the structure onto the relief precursor. In order to do so the mask layer may be non-transparent in the UV region and absorb radiation in the VIS-IR region of the electromagnetic spectrum. The VIS-IR radiation may then be used to heat and ablate the layer. The optical density of the mask layer in the UV region between 330 and 420 nm is in the range of 1 to 5, preferably in the range of 1.5 to 4 and more preferably in the range of 2 to 4. Optical density is determined using a -rite 361TX Densitometer with the setting "Density" with UV-Filter. The optical density of the mask layer in the VIS-IR-region between 340 and 660 nm is in the range of 1 to 5, preferably in the range of 1.5 to 4 and more preferably in the range of 2 to 4. Optical density is determined using a -rite 361TX Densitometer with the setting "Density".

The layer thickness of the ablatable mask layer may be in the range of 0.1 to 5 μm, preferably 0.3 to 4 μm, more preferably 1 to 3 mm. The laser sensitivity of the mask layer (measured as energy needed to ablate 1 $cm^2$) may be in the range of 0.1 to 10 $mJ/cm^2$, preferably in the range of 0.3 to 5 $mJ/cm^2$, most preferably in the range of 0.5 to 5 $mJ/cm^2$.

A first and a second longitudinal thin film side wing 120, 130 are connected to a first and a second opposite longitudinal side 112, 113 of the flexible plate 100, respectively. The two longitudinal thin film side wings 120, 130 protrude outwardly from the opposite longitudinal sides 112, 113 of the flexible plate 100. The thin film side wines 120, 130 have a thickness t which is at least 5 times, more preferably at least 10 times, even more preferably at least 50 times smaller than the thickness T of the flexible plate 100. The thickness T of the flexible plate 100 is the total thickness, i.e. including the thickness of the support layer 170 and any one or more additional layers 110, 160.

According to an exemplary embodiment of the method, the flexible plate 100 is positioned on the drum 200 with the two longitudinal thin film side wings oriented in a circumferential direction of the drum 200, and such that each thin film longitudinal side wing 120, 130 of the flexible plate 100 covers at least one vacuum suction opening 250 of the plurality of vacuum suction openings 250, see FIG. 1A. It is noted that the vacuum suction openings 250 may be elongate slots extending in the circumferential direction of the drum 200. The vacuum suction openings 250 may comprise long slots each extending over substantially the entire circumference of the drum 200, or a plurality of slots spread over the circumference of the drum 200. In yet other embodiments, the vacuum suction openings 250 may be a pattern of holes extending over the entire drum 200. The leading edge 114 and the trailing edge 115 of the flexible plate 100 may be fixed using clamps 300 in a known way. In the variant of FIG. 1A the flexible plate 100 extends over substantially the entire circumference of the drum 200. However, it is also possible to work with smaller flexible plates 100 which have a leading and/or trailing side wing 140, 150 covering an area between the leading and trailing edge 114, 115 of the flexible plate 100, see FIG. 1B. In that case the leading and trailing side wing 140, 150 may be clamped using clamps (not shown in FIG. 1B). In yet other embodiments (not shown in FIG. 1B) only a leading side wing 140 is provided and may be clamped, whilst at the opposite end the trailing edge 115 is clamped; or only a trailing side wing 150 is provided and may be clamped, whilst at the opposite end the leading edge 114 is clamped.

After the positioning of the flexible plate 100 on the drum 200, a vacuum is applied through the plurality of vacuum suction openings 250 and the drum is rotated 200 whilst performing a treatment on at least one layer of the at least one additional layer 110, 160 of the flexible plate 100. The performing of a treatment may comprise removing material from at least one layer of the at least one additional layer 110, 160, e.g. by a laser, in order to obtain a relief structure in the at least one layer. In other embodiments the optional layer 160 may be a mask layer, and the treatment may comprise irradiating the additional layer 110, e.g. a photosensitive layer, through the mask layer 160. More generally the performing of a treatment may comprise any type of treatment, e.g. one of the following: exposure to electromagnetic waves; engraving; exposure to material jets, such as particle jets, fluid jets, gas jets; exposure to a plasma; exposure to a continuous web such as for thermal development; or combinations thereof.

Preferably the thin film side wings 120, 130 are fixed to the support layer 170, and more preferably the thin film side wings 120, 130 are integrated with the support layer 170 (i.e. the support layer 170 and the side wings 120, 130 are provided as an integral layer), as in the embodiment of the FIGS. 2A and 2B.

The plurality of vacuum suction openings 250 form a pattern extending in a circumferential direction and in an axial direction of the drum 200, wherein, seen in the axial direction, the vacuum suction openings 250 are arranged at a predetermined maximum distance d of each other, see FIG. 1A. The width w of each thin film side wing of the flexible plate 100 is larger than said predetermined maximum distance d, such that at least one vacuum suction opening 250 is covered by each thin film side wing 120, 130. The width w of the thin film side wings 120, 130, seen in a direction perpendicular on the opposite sides 112, 113, is preferably larger than 500 micron, more preferably larger than 10 mm, and preferably smaller than 100 mm.

Preferably, the flexible plate 100 is substantially rectangular and the thin film side wings 120, 130 extend over at least 50% of the length of the opposite sides, preferably over at least 75%, more preferably over substantially the entire length of the opposite sides, as illustrated in the embodiment of FIGS. 2A and 2B.

Preferably, the radius of the drum 200 is larger than 15 cm. The length L of the flexible plate 100 may be e.g. between 10 cm and 100 cm, depending on the size of the drum 200. The width W may also vary depending on the length of the drum 200. It is noted that multiple flexible plates may be arranged next to each other on the drum 200.

Preferably, the drum 200 is rotated with a speed which is between 10 and 5000 rpm, more preferable between 250 rpm and 1000 rpm.

By providing the flexible plate 100 with thin film side wings 120, 130 on opposite sides, the flexible plate 100 will be fixed well, without having to tape the flexible plate 100 on the drum. Indeed, the thin film side wings 120, 130 extend over at least one vacuum suction opening 250 so that the opposite sides 112, 113 of the flexible plate 100 are maintained fixed against the drum 200, also when the drum rotates at a high speeds. Any risk that the opposite sides 112, 113 are detached is significantly reduced. The illustrated method results in a faster process which avoids a taping step. Further, since no taping step is needed, the method may be more easily automated by implementing e.g. an automated loading of the flexible plate 100 on the drum 200.

The thin film side wings 120, 130 and/or the support layer 170 may be provided as any one of the following: natural or artificial polymer films, coated paper, a combination thereof. The thin film side wings 120, 130 and/or the support layer 170 may comprise any one of the following materials: polymer or polymer derivatives, such as polyalkene; (polyethylene, polyisoprene, polyhutadiene), polyamines, polyethers, polyols, polyesters (PET), polyamides, polyimides, polysaccharides; starch; cellulose. Preferably, the thin film side wings 120, 130 and/or the support layer 170 have a thickness t which is smaller than 500 micron, e.g. between 100 micron and 400 micron. The flexible plate 100 may have a thickness between 1 mm and 10 mm, preferably between 2 mm and 8 mm, even more preferably between 2 mm and 7 mm.

Exemplary embodiments of the invention also relate to a treated flexible plate 100, e.g. an engraved printing plate, obtained according to the method of any one of the above described embodiments.

Figure 4:
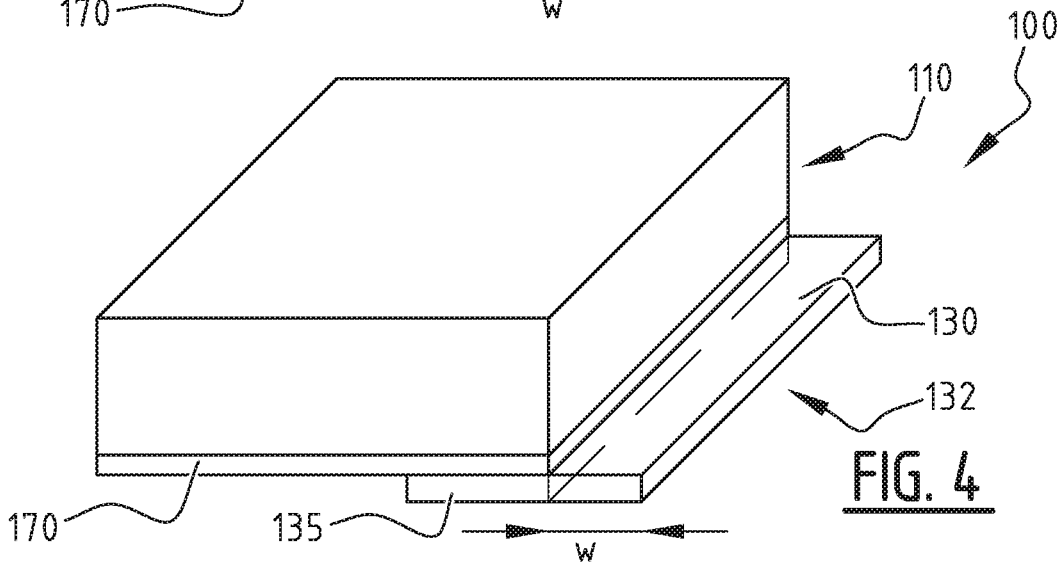

FIG. 4 illustrates an exemplary embodiment of a flexible plate 100 where the thin film side wings (only 130 is shown, but a side wing 120 may be provided in a similar manner) are provided by attaching two bands 132 of thin film material to a bottom face of the support layer 170 at opposite sides 112, 113 of the flexible plate 100, e.g. by gluing. Each band 132 comprise a portion 135 that is adhered to the bottom face of the support layer 170, and a portion 130 that forms the thin film side wing. In this embodiment, the support layer 170 is not part of the same layer as the side wings 130.

Figure 5:
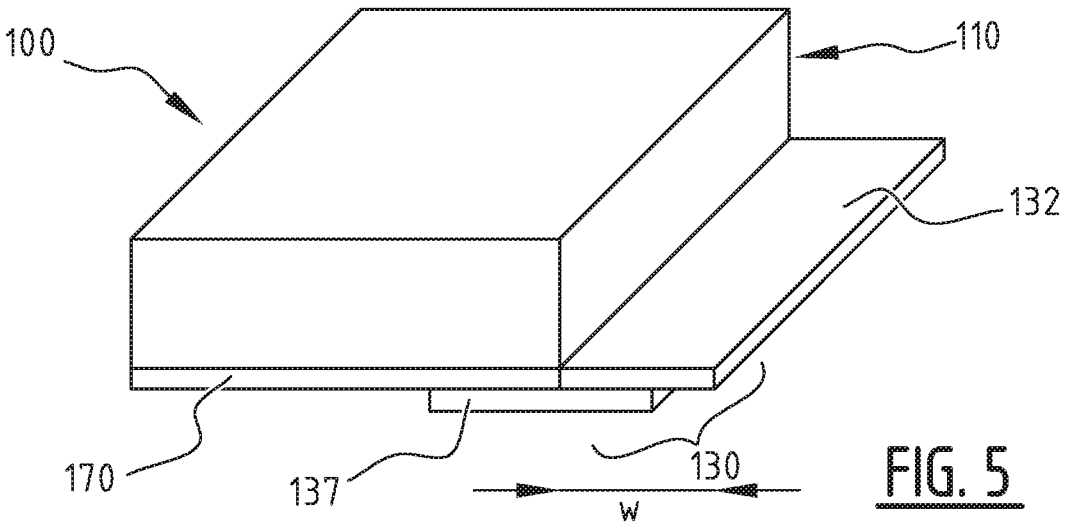

FIG. 5 illustrates an exemplary embodiment of a flexible plate 100 where the thin film side wings (only 130 is shown, hut a side wing 120 may be provided in a similar manner) are provided by attaching two bands 132 of thin film material to a bottom face of the support layer 170 at opposite sides 112, 113 of the flexible plate 100, using a tape 137 which is adhered to the bottom face of the support layer 170 and to a bottom face of the hand 132. The band 132 together with a portion of the tape 137 form the thin film side wing 130. In this embodiment, the support layer 170 is not part of the same layer as the side wings 130.

Figure 6:
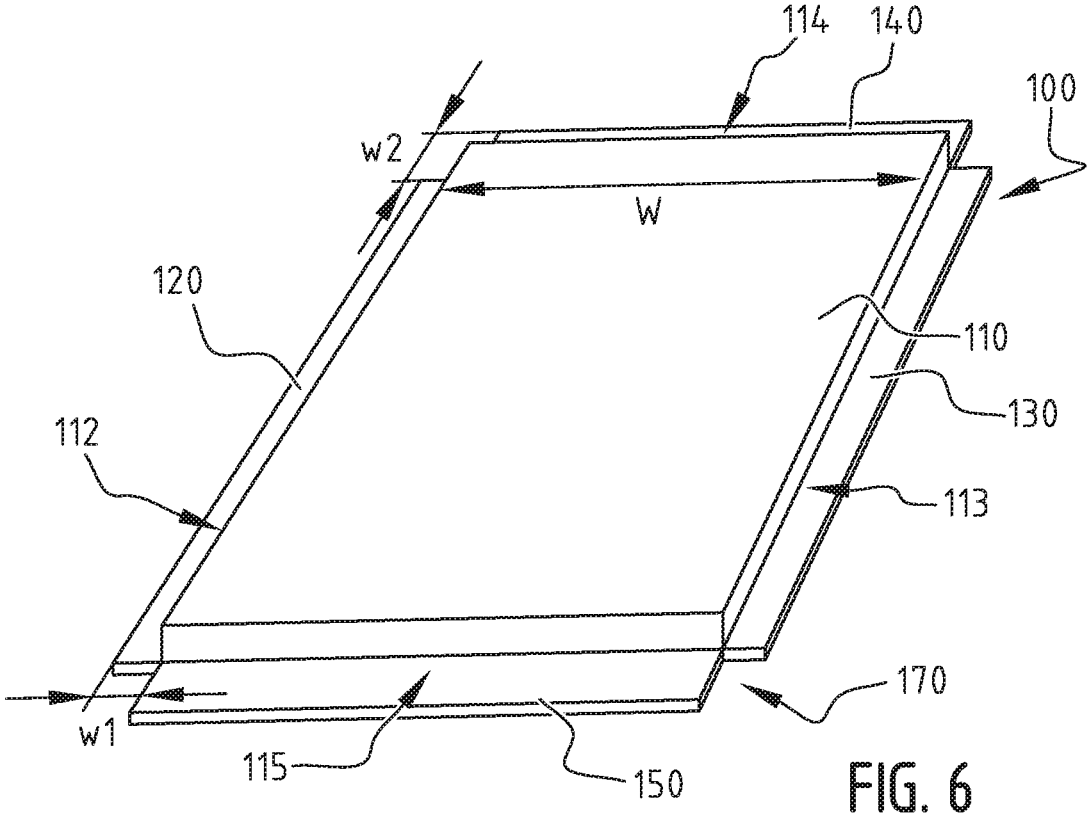
FIGS. 6, 7, 8 and 9 are schematic perspective views of other exemplary embodiments of a flexible plate illustrating various embodiments with one or more thin film side wings.

FIG. 6 illustrates an exemplary embodiment of a flexible plate 100 where not only a first and a second opposite side 112, 113 of the flexible plate 100 are provided with a first and a second longitudinal thin film side wing 120, 130, respectively; but also a leading and trailing edge 114, 115 of the flexible plate 100 are provided with a leading and trailing thin film side wing 140, 150, respectively. Preferably, the leading and trailing thin film wing 140, 150 each extend over at least 50% of the width W of the flexible plate 100, more preferably over at least 75%, and even more preferably over substantially the entire width W. Preferably, the width w1 of the longitudinal thin film side wings 120, 130, seen in a direction perpendicular on the opposite longitudinal sides, is in the range of 0.5 mm to 100 mm, more preferably larger than 10 mm. Preferably, the width w2 of the leading and trailing thin film side wings 140, 150, seen in a longitudinal direction, is larger than 0.5 mm, more preferably larger than 10 mm. In the embodiment of FIG. 6 a leading and trailing thin film side wing 140, 150 is provided, but one could also provide only a leading thin film side wing 140 or only a trailing thin film side wing 150 which may then have a longer width w2. It is noted that the leading and trailing thin film wing 140, 150 may extend over more than 100% of the width W of the flexible plate 100, and that the longitudinal thin film side films 120, 130 may also extend over more than 100% of the length L of the flexible plate 100. For example, the support layer 170 and the thin film side films 120, 130, 140, 150 could be formed out of a single rectangular sheet having a width and length which are larger than W and L, respectively.

Figure 7:
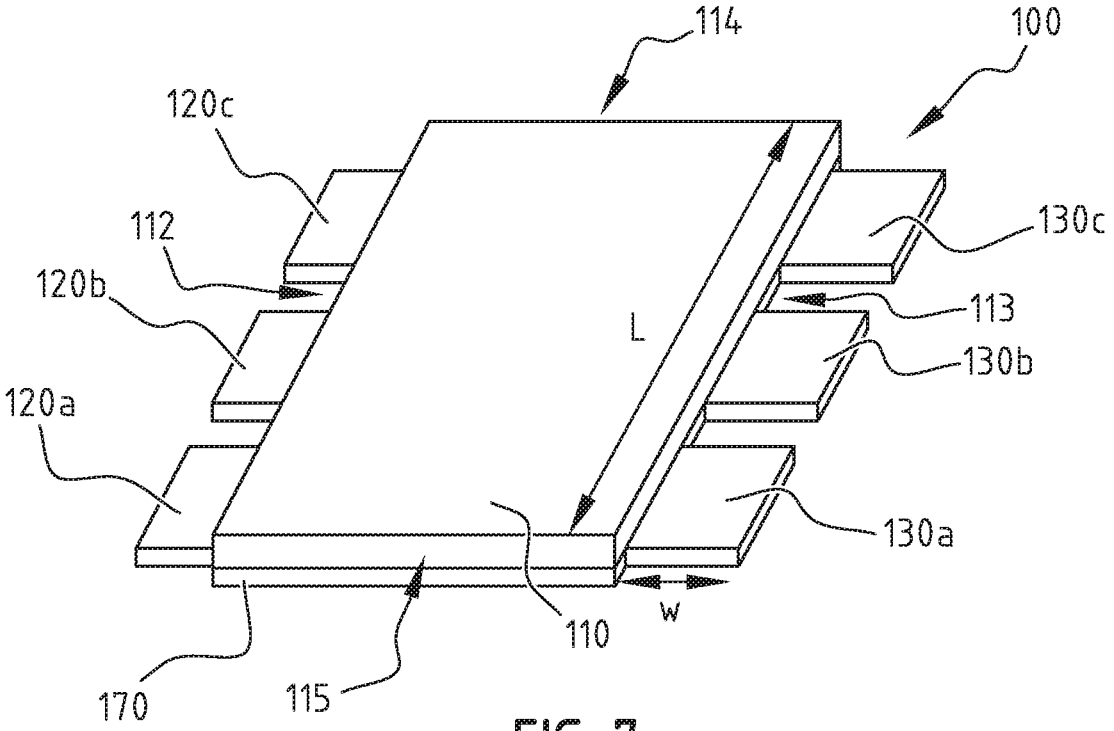

FIG. 7 illustrates an exemplary embodiment of a flexible plate 100 where a first and a second opposite longitudinal side 112, 113 of the flexible plate 100 are provided with a first and a second plurality of shorter thin film side wings 120*a*, 120*b*, 120*c*, 130*a*, 130*b*, 130*c*, respectively. Preferably, the first and second plurality of thin film side wings 120*a*, 120*b*, 120*c*; 130*a*, 130*b*, 130*c* each extends over at least 50% of the length L of the first and second opposite longitudinal side 112, 113. Preferably, the width w of the thin film side wings, seen in a direction perpendicular on the opposite sides, is in the range of 0.5 mm to 100 mm, preferably larger than 10 mm.

Figure 8:
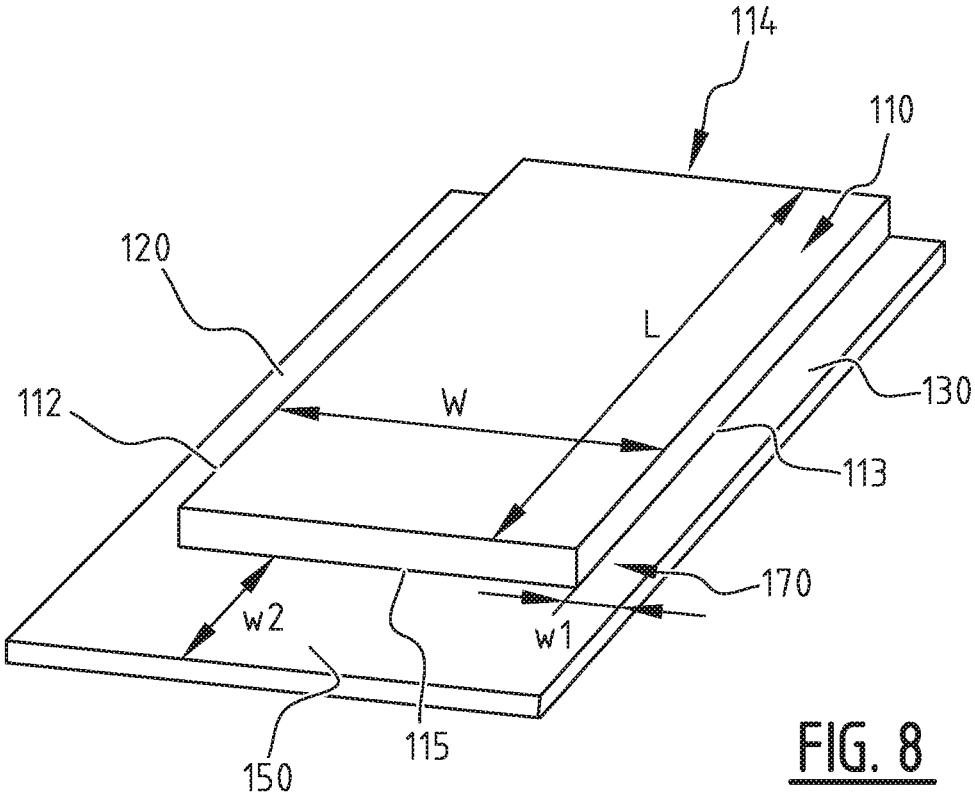

FIG. 8 illustrates an exemplary embodiment of a flexible plate 100 where not only a first and a second opposite side 112, 113 of the flexible plate 100 are provided with a first and a second longitudinal thin film side wing 120, 130 having a width w1, respectively; but also a trailing edge 115 of the flexible plate 100 is provided with a trailing thin film side wing 150 having a width w2. In this embodiment the leading thin film wing 150 extends over more than 100% of the width W of the flexible plate 100, and the longitudinal thin film side films 120, 130 also extend over more than 100% of the length L of the flexible plate 100. In the illustrated embodiment the thin film side wings 120, 130, 150 and the support layer 170 are formed by a single rectangular integral support and side wing layer with a width which corresponds with W+2*w1, and a length L+w2. Preferably, the width w1 of the longitudinal thin film side wings 120, 130, seen in a direction perpendicular on the opposite longitudinal sides, is in the range of 0.5 mm to 100 mm, more preferably larger than 10 mm. Preferably, the width w2 of the trailing thin film side wing 150, seen in a longitudinal direction, is larger than 1 mm, more preferably larger than 15 mm.

Figure 9:
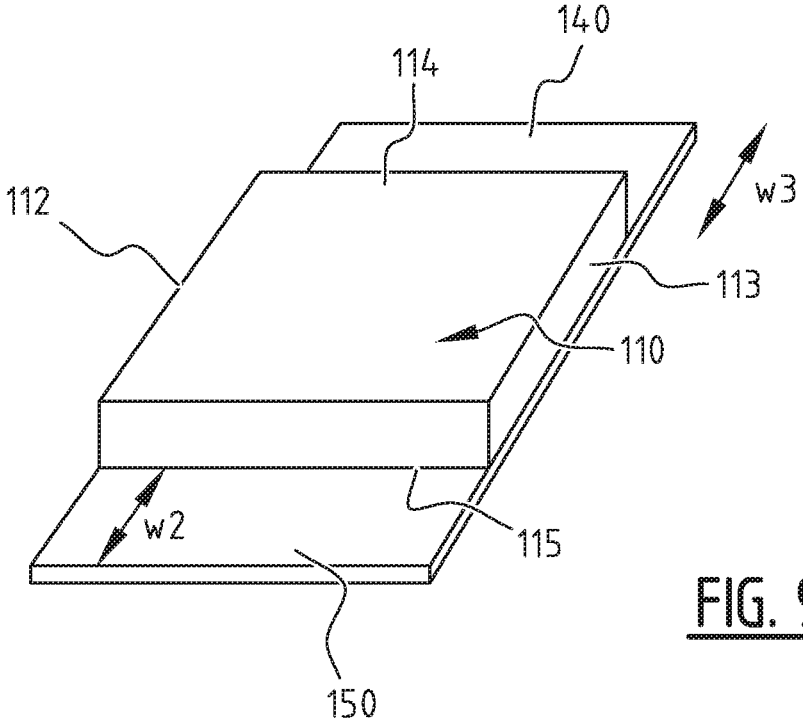

FIG. 9 illustrates an exemplary embodiment of a flexible plate 100 where the first and second opposite side 112, 113 of the flexible plate 100 are not provided with thin film side wings, and where only the leading and trailing edges 114, 115 of the flexible plate 100 are provided with a leading and trailing thin film side wing 140, 150 having a width w2, w3, respectively. Also, in this embodiment the thin film side wings 140, 150 and the support layer 170 are formed by a single rectangular integral support and side wing, layer with a width which corresponds with W, and a length L+w2+w3. Preferably, the width w2, w3 of the leading and trailing thin film side wings 140, 150, seen in a longitudinal direction, is larger than 1 mm, more preferably larger than 10 mm.

Other features of the flexible plate 100 that have been described above for FIGS. 1-3, may also apply for the embodiments of FIGS. 4-9.

Whilst the principles of the invention have been set out above in connection with specific embodiments, it is to be understood that this description is merely made by way of example and not as a limitation of the scope of protection which is determined by the appended claims.

The invention claimed is:

1. A method for fixing and treating a flexible plate on a drum with a plurality of vacuum suction openings, said method comprising the steps:

providing a flexible plate comprising a support layer made of a first material and at least one additional layer made of a second material which is different from said first material, wherein one or more thin film side wings are connected to one or more sides of the flexible plate, said one or more thin film side wings having a thickness which is at least 5 times smaller than the thickness of the flexible plate, said one or more thin film side wings having a lower face which is substantially free from adhesive;

positioning the flexible plate on the drum such that the lower face of each thin film side wing of the flexible plate covers at least one vacuum suction opening of the plurality of vacuum suction openings; and rotating the drum while applying vacuum through the plurality of vacuum suction openings, and performing a treatment on at least one layer of said at least one additional layer of the flexible plate while rotating the drum.

2. The method of claim 1, wherein the one or more thin film side wings comprise two longitudinal thin film side wings at opposite longitudinal sides of the flexible plate, and wherein the flexible plate is positioned on the drum with the two longitudinal thin film side wings oriented in a circumferential direction of the drum.

3. The method of claim 2, wherein the plurality of vacuum suction openings form a pattern extending in a circumferential direction and in an axial direction of the drum, wherein, seen in the axial direction the vacuum suction openings are arranged at a predetermined maximum distance of each other, and wherein a width (w) of each longitudinal thin film side wing of the flexible plate is larger than said predetermined maximum distance, such that at least one vacuum suction opening is covered by each longitudinal thin film side wing; wherein the width of the longitudinal thin film side wings, seen in a direction perpendicular on the opposite longitudinal sides, is larger than 0.5.

4. The method of claim 1, wherein the one or more thin film side wings comprise a leading and/or trailing thin film side wing attached to a leading and/or trailing edge of the flexible plate; and wherein the flexible plate is positioned on the drum with the leading and/or trailing thin film side wing oriented parallel to an axial direction of the drum such that, when positioned on the drum, the leading and/or trailing thin film side wing cover a portion between the leading edge and the trailing edge of the flexible plate.

5. The method of claim 1, wherein the performing of a treatment comprises removing material from at least one layer of the at least one additional layer.

6. The method of claim 1, wherein the one or more thin film side wings are fixed to the support layer.

7. The method of claim 1, wherein the one or more thin film side wings and the support layer are formed as one integral film.

8. The method of claim 1, wherein the flexible plate is substantially rectangular.

9. The method of claim 1, wherein the one or more thin film side wings each extend over at least 50% of the length of the respective side.

10. The method of claim 1, wherein the at least one additional layer comprises a photosensitive layer.

11. The method of claim 1, wherein the radius of the drum is larger than 15 cm.

12. The method of claim 1, wherein the drum is rotated with a speed between 10 and 5000 rpm.

13. The method of claim 1, wherein the flexible plate is a relief precursor; wherein the relief precursor is any one of the following: a direct engravable plate, such as a plate with an ablatable mask layer; a solvent or water developable plate; a thermally developable plate; a plate with a photosensitive layer, a plate with a photosensitive layer and an ablatable mask layer; a micro reactor; and a Fresnel lens.

14. The method of claim 1, wherein the one or more thin film side wings are provided as any one of the following: natural or artificial polymer films, coated paper, and a combination thereof.

15. The method of claim 1, wherein the one or more thin film side wings have a thickness which is smaller than 0.5 mm.

16. A treated flexible plate obtained according to the method of claim 1.

17. The method of claim 1, wherein said one or more thin film side wings has a thickness which is at least 10 times smaller than the thickness of the flexible plate.

18. A flexible plate suitable to be fixed on a drum, said flexible plate comprising:

a support layer made of a first material and at least one additional layer made of a second material which is different from said first material, said additional layer configured to be treated while fixed on the drum, wherein one or more thin film side wings are connected to one or more sides of the flexible plate, wherein said one or more thin film side wings has a thickness which is at least 5 times smaller than the thickness of the flexible plate; and wherein said one or more thin film side wings has a lower face which is substantially free from adhesive.

19. The flexible plate according to claim 18, wherein the one or more thin film side wings are fixed to the support layer.

20. The flexible plate according to claim 18, wherein the one or more thin film side wings and the support layer are formed as one integral film.

21. The flexible plate according to claim 18, wherein the flexible plate has a thickness between 1 and 10 mm.

22. The flexible plate according to claim 18, wherein the flexible plate has a leading edge and a trailing edge and two opposite longitudinal sides extending between the leading and the trailing edge; wherein the one or more thin film side wings comprise:

two longitudinal thin film side wings connected to the opposite longitudinal sides of the flexible plate; and/or a leading and/or trailing thin film side wing connected to the leading and/or trailing edge of the flexible plate, wherein the width of the two longitudinal thin film side wings, seen in a direction perpendicular on the opposite longitudinal sides of the flexible plate, is in the range of 0.5 mm to 100 mm.

23. The flexible plate according to claim 18, wherein the at least one additional layer comprises a photosensitive layer and a mask layer.

24. The flexible plate according to claim 18, wherein the thickness of the one or more thin film side wings is smaller than 0.5 mm.

* * * * *